US005664384A

United States Patent [19]

Cullinan

[11] Patent Number: 5,664,384

[45] Date of Patent: Sep. 9, 1997

[54] SCREENING DEVICE

[76] Inventor: James E. Cullinan, 2737 Welsford Rd., Columbus, Ohio 43221

[21] Appl. No.: 638,289

[22] Filed: Apr. 26, 1996

[51] Int. Cl.[6] ..... E04B 2/60

[52] U.S. Cl. ..... 52/507; 52/19; 52/69; 52/72; 52/506.06; 52/506.07; 52/656.8; 52/800.12; 52/800.13

[58] Field of Search ..... 52/19, 69, 72, 52/506.06, 506.07, 800.12, 800.13, 507, 656.8

[56] References Cited

U.S. PATENT DOCUMENTS

| | | | |
|---|---|---|---|
| 1,460,098 | 6/1923 | Houser . | |
| 3,720,432 | 3/1973 | Chudler | 52/506.06 X |
| 3,742,659 | 7/1973 | Drew | 52/72 X |
| 3,890,989 | 6/1975 | Kuxhouse et al. . | |
| 4,001,985 | 1/1977 | Nikolaus et al. | 52/506.06 X |
| 4,263,763 | 4/1981 | Bouwens | 52/506.06 X |
| 4,488,565 | 12/1984 | Smith . | |
| 4,498,262 | 2/1985 | Garcia . | |
| 4,541,208 | 9/1985 | Vesperman et al. | 52/72 X |
| 4,550,534 | 11/1985 | Mariano et al. | 52/19 |
| 4,769,965 | 9/1988 | Shaub | 52/506.07 |

*Primary Examiner*—Christopher T. Kent
*Attorney, Agent, or Firm*—Philip M. Dunson; Philip J. Pollick

[57] ABSTRACT

A device is provided with a substantially rigid sheet having a pair of parallel opposite edges; and a holder for holding the sheet at a position in stable equilibrium at a predetermined location; the sheet and the holder being so constructed and arranged that the sheet can be moved easily to and away from the location by a person without a need for equipment. One typical holder includes a framework including an upper rigid elongate substantially channel shaped member held in an upper lengthwise horizontal position with its channel opening substantially downward; and a lower rigid elongate substantially channel shaped member held in a lower lengthwise horizontal position with its channel parallel to, and opening substantially upward toward, the channel opening in the upper member; the depth of the channel opening in the upper member being enough greater than the depth of the channel opening in the lower member, and the spacing between the two channel openings being such that the upper edge of the sheet can be inserted a substantial distance upward into the upper member and while so inserted the lower edge can be placed adjacently above the lower channel opening and dropped therein leaving the upper edge of the sheet still sufficiently inside the upper channel as to confine the sheet within the two channels until it is intentionally moved away by a person pushing the sheet upward into the upper channel sufficiently for the lower edge to be pulled out of, and away from, the lower channel, and then pulling the sheet downward sufficiently for the upper edge to be pulled out of, and away from, the upper channel. Another typical holder includes a framework for holding the sheet thereon at the predetermined location; and hinge for enabling the framework and the sheet to be moved selectively away from, and back to, the location by pivoting them through a predetermined angle around an axis in the proximity of an edge of the framework.

9 Claims, 4 Drawing Sheets

SCREENING DEVICE

FIELD

This invention relates to screening devices and related types of apparatus. It has to do primarily with apparatus for screening the view of large outdoor equipment where it is necessary or desirable to improve its appearance in public places. For example, the invention can provide attractive screening for heating, ventilating, and air conditioning equipment on top of business establishments in areas of a city where all outdoor structures are required to have a pleasing appearance.

BACKGROUND

The screening apparatus for large equipment can be difficult and time consuming to remove when it is necessary to make repairs or adjustments, unless the screening apparatus is constructed and arranged so that it can be moved easily from its normal location around the equipment. Preferably the screening apparatus should be capable of being moved quickly and easily away from, and back to, its normal screening location by a person without a need for equipment to do the moving. It is therefore the main purpose of the present invention to provide quick and easy access to the screened unit, while providing an attractive appearance at all other times.

DISCLOSURE

The appearance of large electrical and mechanical equipment is made attractive by surrounding the equipment with apparatus according to the present invention, as by placing plain or ribbed sheets of metal, plastic, cloth or other suitable material in a large rectangular frame on each side of the equipment that the apparatus screens. The sheets typically comprise a plurality of panels that are completely removable by lifting them up and out of the framework. Where it is desired that the lower horizontal member of the framework be quickly removable also, a release pin may be provided at each end of the lower horizontal member.

Alternatively the framework may be hinged along its top edge so that the framework can be lifted up from the bottom to move the frame and its contents, either as whole or in parts, away from the screening location, to permit easy access to the equipment for servicing. The frame can be supported there at its upper position by prop rods, gas cylinders, or other known supporting means.

Other typical features of the invention may include:

Quick access to the electrical switching in the equipment, providing access by the service person to quickly disconnect electrical power to malfunctioning equipment.

Ribbed formed plastic panels to provide the stiffness required to resist blowout by the wind, and yet be light enough in weight for a person to remove any section of the screen without fear of puncturing the sometimes fragile roofing membrane.

Separate supporting members such as those shown in FIGS. 6 and 7. Parts of the screening apparatus (or all of it, including the tetrahedron-shaped corner members as shown especially in FIG. 2), can be separately supported so that the apparatus, where it is so desired, need not be connected at all to the equipment that it surrounds.

Means, such as clips in FIG. 8, to hold the lower ends of the panels in the lower channel of the framework to prevent dislodgement therefrom by high wind or other accidental force.

DRAWINGS

CARRYING OUT THE INVENTION

Figure 1:
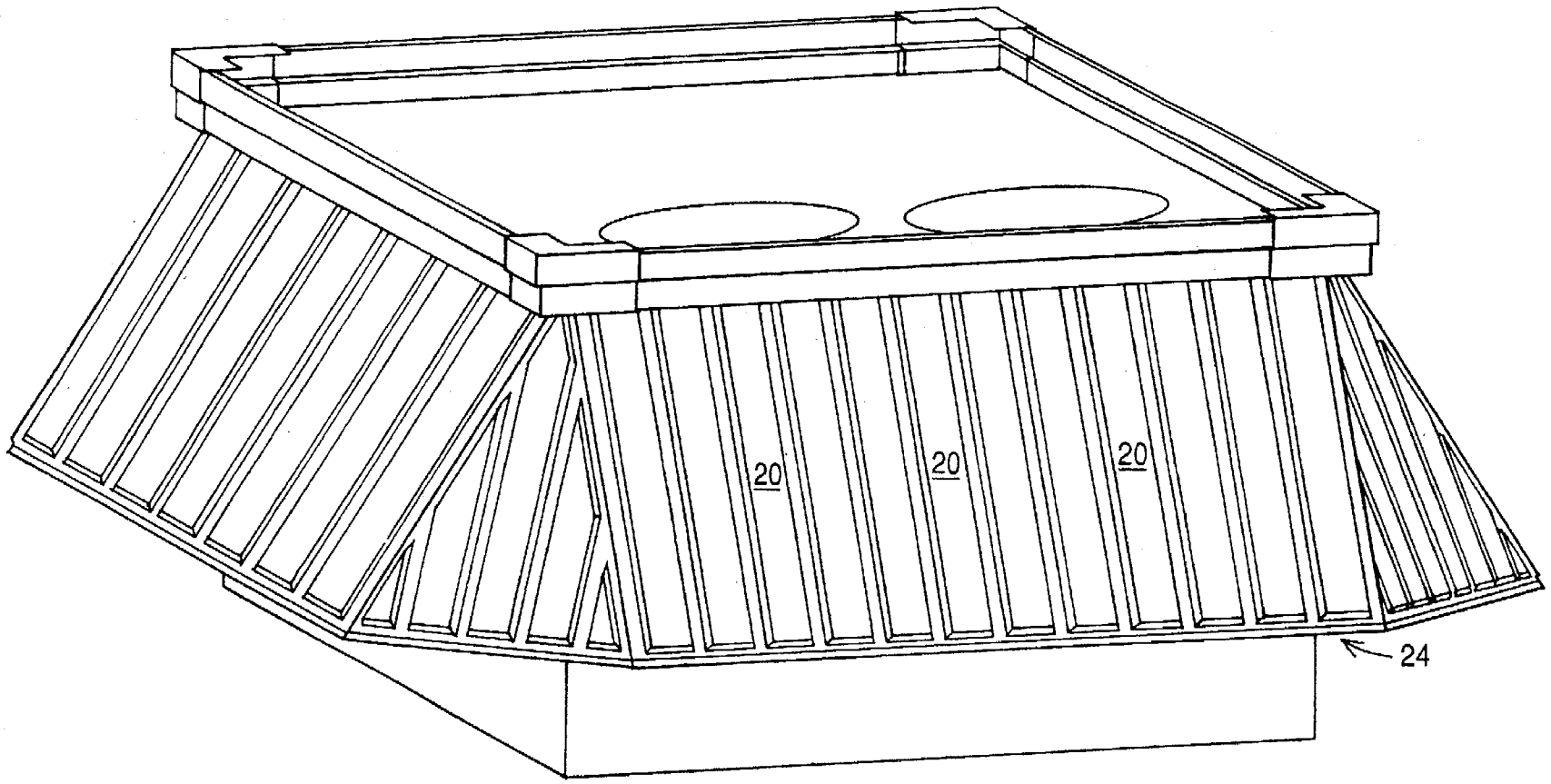
FIG. 1 is a perspective view of typical apparatus according to the present invention.
Figure 2:
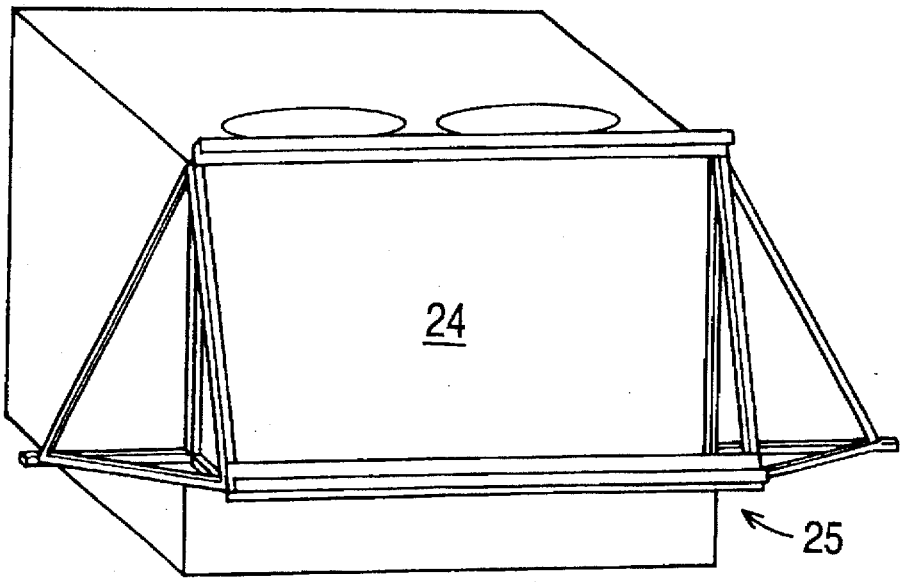
FIG. 2 is a perspective view of part of the apparatus in FIG. 1.

Referring now to the drawings, typical apparatus according to the present invention comprises

- a substantially rigid sheet 20 having a pair of parallel opposite edges 21,22; and
- means 23 for holding the sheet 20 at a predetermined location 24;
- the sheet 20 and the holding means 23 being so constructed and arranged that the sheet can be moved easily to and away from the location 24 by a person without a need for equipment.

Figure 4:
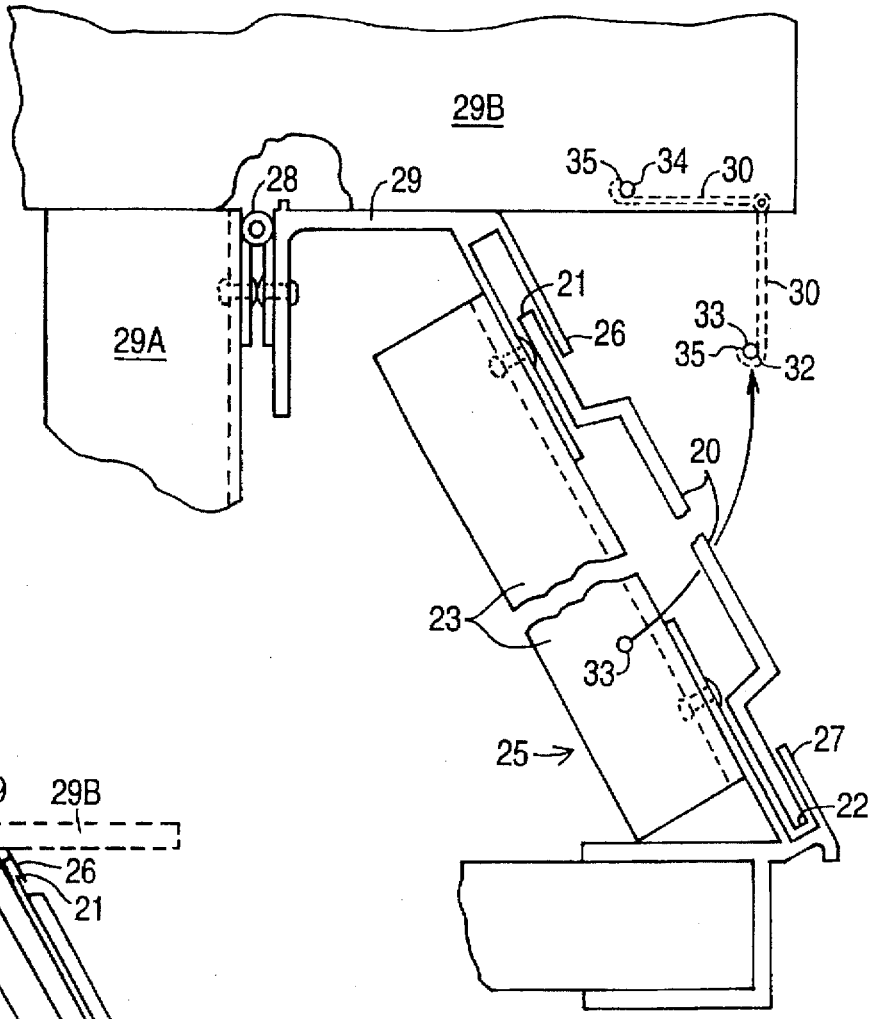
FIG. 4 is an enlarged, partly schematic, side view of typical portions of the apparatus in FIGS. 1–3.
Figure 5:
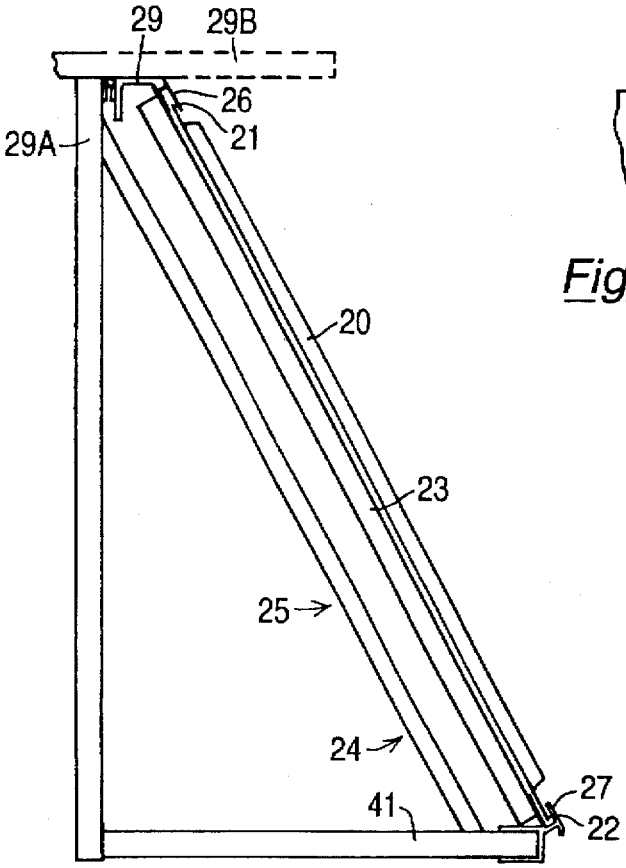
FIG. 5 is an enlarged side view (but smaller than FIGS. 3 and 4) of typical components of the apparatus in FIG. 2, including some of the components in FIGS. 3 and 4.
Figure 7:
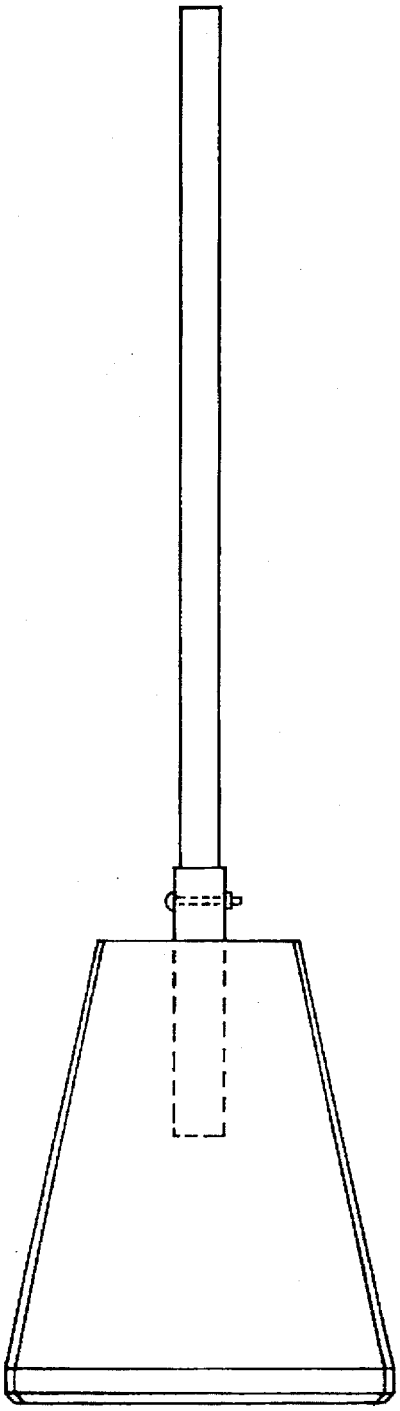
FIG. 7 is an elevation view of a supporting member as in FIG. 6.
Figure 6:
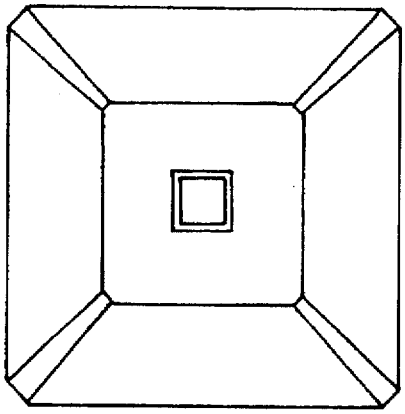
FIG. 6 is a top view of a typical alternative supporting member for parts of the apparatus as in FIGS. 1–5.

In typical preferred embodiments of the invention, as illustrated especially in FIGS. 4 and 5 (omitting the hinged connection 28 in FIG. 4 and with the upper member 29 of the screening framework fixedly connected by welding, or rivets, or other known means either to an upright support member 29A or to a horizontal fixedly positioned member 29B), the holding means 23 comprises a framework 25 including

- an upper rigid elongate substantially channel shaped member 26 held in an upper lengthwise horizontal position with its channel opening substantially downward; and
- a lower rigid elongate substantially channel shaped member 27 held in a lower lengthwise horizontal position with its channel parallel to, and opening substantially upward toward, the channel opening in the upper member 26;
- the depth of the channel opening in the upper member 26 being enough greater than the depth of the channel opening in the lower member 27, and the spacing between the two channel openings being such that the upper edge 21 of the sheet 20 can be inserted a substantial distance upward into the upper member 26 and while so inserted the lower edge 22 can be placed adjacently above the lower channel opening and dropped therein leaving the upper edge 21 of the sheet 20 still sufficiently inside the upper channel as to confine the sheet 20 within the two channels until it is intentionally moved away by a person pushing the sheet 20 upward into the upper channel sufficiently for the lower edge to be pulled out of, and away from, the lower channel, and then pulling the sheet 20 downward sufficiently for the upper edge to be pulled out of, and away from, the upper channel.

Figure 3:
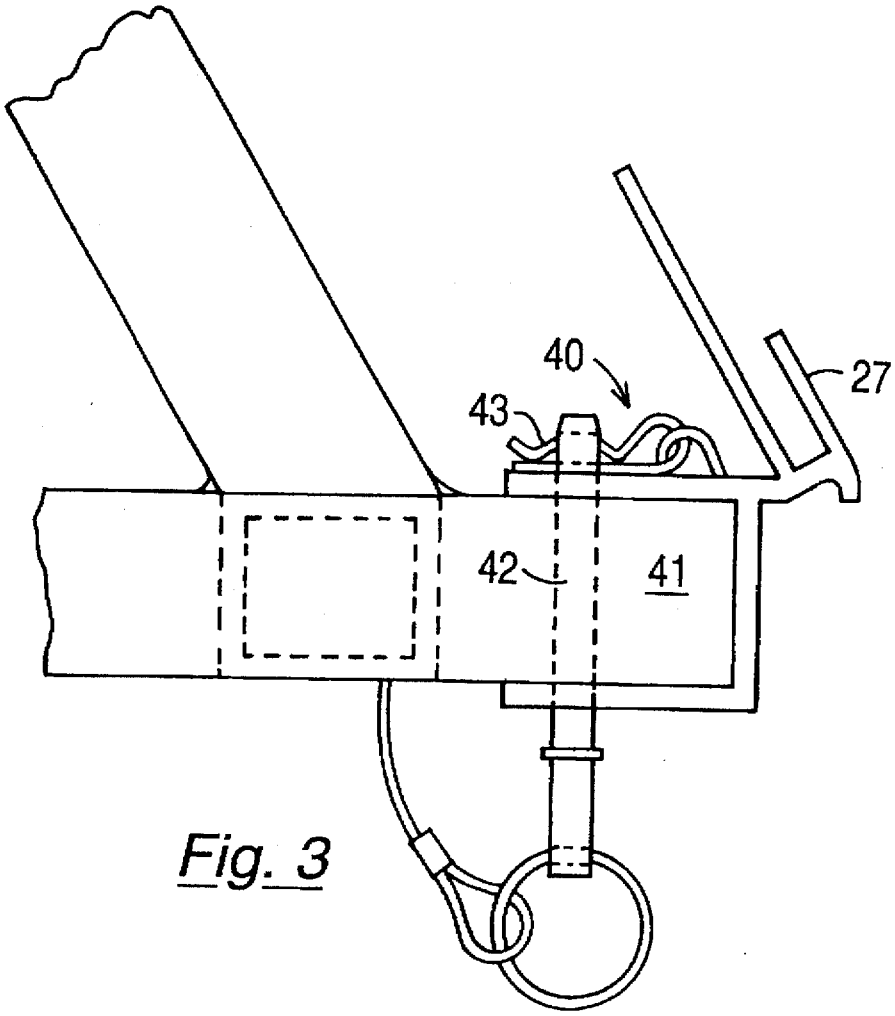
FIG. 3 is an enlarged side view of typical components of the invention and their arrangement at a lower end of the apparatus in FIG. 2.

Such apparatus typically comprises also means 40 for enabling the lower elongate member 27 to be moved easily to and away from the predetermined location 24 when the sheet 20 is out of the lower channel. Typically the enabling means 40 comprises means 42,43 for selectively fastening the lower elongate member 27 to, and unfastening it from, a supporting member 41. As illustrated in FIG. 3, typical means 40 hold the lower elongate member 27 in its normal location 24 by a rod 42 that passes through aligned cylindrical holes in the members 27 and 41. The rod 42 is held thus by a cotter pin 43 passing through a transverse cylindrical hole in the upper end of the rod 42. To unfasten the member 27 from the member 41, the cotter pin 43 is pulled away form the rod 42, allowing it to be removed and thus permitting the members 27 and 41 to be separated from each other.

Figure 8:
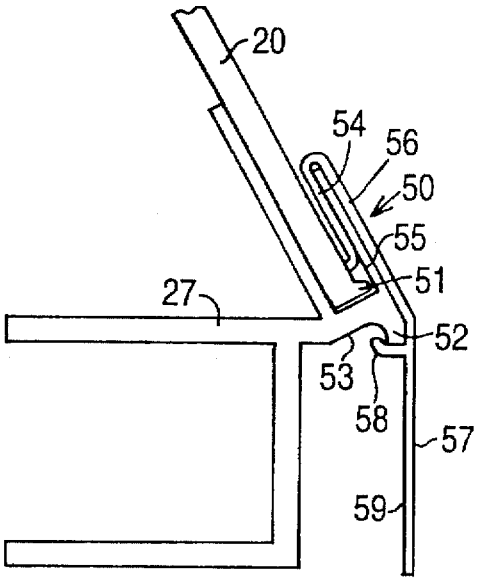
FIG. 8 is a side view of alternative typical components and their arrangement at a lower end of the apparatus in FIG. 2.

As illustrated in FIG. 8, the apparatus may comprise also means 50 for holding the lower end of the sheet 20 snug in the lower channel while the sheet 20 is normally positioned therein, to prevent its being dislodged therefrom by high wind or other accidental force thereon. Where the lower edge of the sheet 20 includes a region 51 that extends outwardly beyond the surface of the sheet 20; and the lower elongate member 27 includes a region 52 that extends downwardly beyond its lower surface 53;

the holding means typically comprises clip means 50 having an upper end potion fitting snug between a surface of the sheet 20 and the adjacent inner surface of the lower channel to block any otherwise possible upward movement past it by the outwardly extending region 51 at the lower edge of the sheet 20;

a middle portion 56 that extends from the upper end portion 54 and fits snugly around the outer surface of the lower channel, and is held thereon by a lower end portion 57 extending from the middle portion 56 and having a projecting shallow hook-like region 58 that fits tightly around the downwardly extending region 52 of the lower elongate member 27, except when intentionally loosened by a person bending it way therefrom by pressing against a downwardly extending handle portion 59 in the lower end portion 57 of the clip means 50.

In other typical embodiments of the invention the holding means 23 comprises a framework 25 for holding the sheet 20 thereon at the predetermined location 24; and means 28 for enabling the framework 25 and the sheet 20 to be moved selectively away from, and back to, the location 24 by pivoting them through a predetermined angle around an axis in the proximity of an edge of the framework 25. Typically the framework 25 has at least one substantially straight extremity 29 and the enabling means comprises hinge means 28 for permitting the pivoting of the framework 25 about an axis on, or parallel to, that extremity 29. The apparatus typically comprises also means 30 for holding the framework 25 in stable equilibrium at a predetermined position away from the location 24 when pivoted thereto by a person, as well as means 35 for enabling a person to release the holdings means 30 and pivot the frame 25 back to the predetermined location 24. The holding and releasing components 30–35 are shown schematically rather than in detail in FIG. 4 with the hooked end 35 keeping the holding member 30 held out of sight by the pin 34 when the framework 25 is in its normal screening location 24; and with the hooked end 35 of the member 30 positioned beneath the pin 33 on the sheet holding framework 25 when it is lifted to its out of the way position at 32.

While the forms of the invention herein disclosed constitute currently preferred embodiments, many others are possible. It is not intended herein to mention all of the possible equivalent forms or ramifications of the invention. It is to be understood that the terms used herein are merely descriptive rather than limiting, and that various changes may be made without departing from the spirit and scope of the invention.

I claim:

1. Apparatus comprising a sheet having a pair of parallel opposite edges; and means for holding the sheet at a predetermined location;

the holding means comprising a framework including an upper rigid elongate substantially channel shaped member held in an upper lengthwise horizontal position with an upper channel opening facing substantially downward; and a lower rigid elongate substantially channel shaped member held in a lower lengthwise horizontal position with a lower channel opening being parallel to, and facing substantially upward toward the upper member;

a depth of the upper channel opening being enough greater than a depth of the lower channel opening and spacing between the two channel opening being such that an upper edge of the sheet can be inserted a substantial distance upward into the upper member and while so inserted a lower edge of the sheet can be placed adjacently above the lower channel opening and dropped therein leaving the upper edge of the sheet still sufficiently inside the upper channel opening as to confine the sheet within the two channel openings until said is intentionally moved away by a person pushing the sheet upward into the upper channel opening sufficiently for the lower edge to be pulled out of, and away from, the lower channel opening, and then pulling the sheet downward sufficiently for the upper edge to be pulled out of, and away from, the upper channel opening;

the sheet and the means for holding thus being so constructed and arranged that the sheet can be moved easily to and away from the location by a person without a need for equipment.

2. Apparatus as in claim 1, comprising also means for enabling the lower elongate member to be moved easily to and away from the predetermined location when the sheet is out of the lower channel opening.

3. Apparatus as in claim 2, wherein the means for enabling comprises means for selectively fastening the lower elongate member to, and unfastening it from, a supporting member.

4. Apparatus as in claim 1, comprising also means for holding the lower edge of the sheet snug in the lower channel opening while the sheet is normally positioned therein, to prevent said sheet from being dislodged by high wind or other accidental force thereon.

5. Apparatus as in claim 4, wherein the lower edge of the sheet includes an outwardly extending region that extends beyond a surface of the sheet;

the lower elongate member includes a downwardly extending region that extends beyond a lower surface of said lower elongate member; and the means for holding the lower edge of the sheet comprises clip means having an upper end portion fitting snug between a surface of the sheet and a adjacent inner surface of the lower channel opening to block any otherwise possible upward movement past said upper end portion by the outwardly extending region at the lower edge of the sheet;

a middle portion that extends from the upper end portion and fits snugly around an outer surface of the lower channel, and is held thereon by a lower end portion extending from the middle portion and having a projecting shallow hook-like region that fits tightly around the downwardly extending region of the lower elongate member, except when intentionally loosened by a person bending it away therefrom by pressing against a downwardly extending handle portion in the lower end portion of the clip means.

6. Apparatus comprising a sheet having a pair of parallel opposite edges; and means for holding the sheet at a predetermined location;

the means for holding comprising a framework for holding the sheet thereon at the predetermined location; and means for enabling the framework and the sheet to be moved selectively away from, and back to, the location by pivoting the framework and the sheet through a predetermined angle around an axis proximate to an edge of the framework;

the sheet and the means for holding thus being so constructed and arranged that the sheet can be moved easily to and away from the location by a person without a need for equipment.

7. Apparatus as in claim 6, wherein the framework has at least one substantially straight extremity and the means for enabling comprises hinge means for permitting pivoting of the framework about an axis on, or parallel to, said extremity.

8. Apparatus as in claim 7, comprising also means for holding the framework in stable equilibrium at a predetermined position away from the location when pivoted thereto by a person.

9. Apparatus as in claim 8, comprising also means for enabling a person to release the holding means and pivot the framework back to the predetermined location.

* * * * *

UNITED STATES PATENT AND TRADEMARK OFFICE

CERTIFICATE OF CORRECTION

PATENT NO. : 5,664,384

DATED : September 9, 1997

INVENTOR(S) : James E. Cullinan

It is certified that error appears in the above-indentified patent and that said Letters Patent is hereby corrected as shown below:

Column 3, line 30, delete "potion" and insert therefor - - portion - -.

Column 4, line 37, delete "said " and insert therefor - - said sheet - -.

Column 5, line 2, delete "a" and insert therefor - - an - -.

Signed and Sealed this

Third Day of March, 1998

Bruce Lehman

*Attest:*

BRUCE LEHMAN

*Attesting Officer*

*Commissioner of Patents and Trademarks*